US007527010B2

(12) United States Patent
Heideman et al.

(10) Patent No.: US 7,527,010 B2
(45) Date of Patent: May 5, 2009

(54) VESSEL WITH MOORING SYSTEM, AND MOORING SYSTEM

(75) Inventors: Rik Robert Heideman, Haarlem (NL); Hendrik Cornelis Ynze Ter Horst, Heemstede (NL); Clemens Gerardus Johannes Maria Van Der Nat, Den Haag (NL); Pieter Cornelis Burger, Zoetermeer (NL)

(73) Assignee: Bluewater Energy Services B.V., Hoofddorp (NL)

( * ) Notice: Subject to any disclaimer, the term of this patent is extended or adjusted under 35 U.S.C. 154(b) by 0 days.

(21) Appl. No.: 11/833,639

(22) Filed: Aug. 3, 2007

(65) Prior Publication Data

US 2008/0202404 A1 Aug. 28, 2008

(30) Foreign Application Priority Data

Aug. 7, 2006 (EP) ..... 06118528

(51) Int. Cl.
*B63B 21/00* (2006.01)

(52) U.S. Cl. ..... 114/230.12; 441/5

(58) Field of Classification Search ..... 114/230.1, 114/230.12, 120.13; 441/4, 5, 3
See application file for complete search history.

(56) References Cited

U.S. PATENT DOCUMENTS 5,052,322 A * 10/1991 Poldervaart et al. .... 114/230.12
5,266,061 A 11/1993 Poldervaart et al.
6,477,974 B2 * 11/2002 Hobdy ..... 114/230.12
6,588,357 B1 * 7/2003 Hobdy ..... 114/230.1
7,225,749 B2 * 6/2007 Boatman ..... 114/230.12

FOREIGN PATENT DOCUMENTS

EP 0338605 10/1989

OTHER PUBLICATIONS

Official Search Report of the European Patent Office in counterpart foreign application No. 06118528.6 EP filed Aug. 7, 2006.

* cited by examiner

*Primary Examiner*—Lars A Olson
(74) *Attorney, Agent, or Firm*—Steven M. Koehler; Westman, Champlin & Kelly, P.A.

(57) ABSTRACT

Vessel with mooring system, comprising a turret anchored to the seabed and a turret casing being part of the vessel, wherein the turret and turret casing are interconnected by a connecting element comprising a bearing arrangement and wherein the connecting element has a first end connected to the turret casing and an opposite second end connected to the turret. The connecting element is positioned in such a manner that it experiences tensile forces. When the turret downwardly loads the turret casing the first end of the connecting element is positioned at a higher level then the second end thereof. When the turret upwardly loads the turret casing the first end of the connecting element is positioned at a lower level then the second end thereof.

20 Claims, 1 Drawing Sheet

VESSEL WITH MOORING SYSTEM, AND MOORING SYSTEM

BACKGROUND

Aspects of the invention firstly relate to a vessel with mooring system, comprising a turret anchored to the seabed and a turret casing being part of the vessel, wherein the turret and turret casing are interconnected by a connecting element comprising a bearing arrangement and wherein the connecting element has a first end connected to the turret casing and an opposite second end connected to the turret.

It is noted that although in the present description the indication "vessel" is used, this expression is not intended to restrict the scope of the present invention to ships or boats, but extends to a wide variety of devices floating on the surface of the sea, such as but not limited to buoys or floating production facilities.

A mooring system is used for mooring the vessel while allowing a rotation thereof, such that the vessel can weathervane for assuming a position in which the loads on the mooring system (but also on the vessel) are minimised.

The turret defines a substantially geostatic part which, for example, may be anchored to the seabed using anchoring lines. The turret casing, which often (in case of an internal mooring system) is integrated in a so-called moonpool at a forward part of the vessel (but which also could be part of an outrigger extending beyond the hull of the vessel, and thus defines an external mooring system) defines a part of the vessel which will move therewith, and thus relative to the (geostatic) turret. The connection between the turret and the turret casing therefore is defined by a connecting element which comprises a bearing assembly providing for said rotating connection between the turret casing and the turret.

For a proper operation of such a mooring system it is required that the bearing assembly maintains its function (i.e. allowing a relative rotation between the turret and turret casing) under all circumstances. Thus it is important to prevent deformations of the hull of the vessel (as may or surely will occur under influence of, for example, the waves) from being transferred to the bearing arrangement (or, oppositely, to prevent deformations of the turret from being transferred to the bearing arrangement), thus preventing a detrimental deformation of the bearing assembly (which might lead to a locking thereof).

It is noted that, although here the prevention of deformations is mentioned, it should be kept in mind that essentially it only is required to limit deformations to a level at which the proper operation of the bearing arrangement is not negatively influenced.

For preventing an undesired deformation of the bearing assembly basically two types of designs are known to date. Firstly, the design of the "torsion-box" type utilises a very stiff structure (torsion-box) surrounding the bearing (for example integrated into the hull or turret casing of the vessel when the bearing arrangement is positioned at the first end of the connecting element). Thus, deformations of the hull of the vessel cannot or hardly be transferred to the bearing assembly (neither deformations from the turret) because the torsion-box cannot or hardly be deformed. Secondly, the design of the "cone" type utilises as a connecting element a rather flexible truncated cone-like construction which with its wider base is connected to the vessel (i.e the turret casing) and the narrower top of which supports the bearing assembly which is connected to the turret. Due to the inherent flexibility of such a truncated cone this design substantially prevents deformations of the hull of the vessel from being transferred to the bearing assembly (instead, the cone itself will deform while the bearing assembly maintains its original circular shape). However, when using such a cone there is dilemma in its design. On one hand the cone should be sufficiently flexible for allowing its deformation upon a deformation of the hull of the vessel. On the other hand, however, the cone should be sufficiently strong (stiff) to prevent it from collapsing (buckling) due to the considerable loads (primarily the vertical loads such as the mooring and riser loads and the weight of the turret with all its components) exerted at its top (through the bearing assembly).

SUMMARY

In accordance with an aspect of the present invention there is provided a vessel with a mooring system, comprising a turret anchored to the seabed and a turret casing being part of the vessel, wherein the turret and turret casing are interconnected by a connecting element comprising a bearing arrangement and wherein the connecting element has a first end connected to the turret casing and an opposite second end connected to the turret. The connecting element is positioned in such a manner that it experiences tensile forces.

Tensile forces can be accommodated easily without the need for an extremely strong (stiff) construction of the connecting element. Yet, the connecting element can be sufficiently flexible to substantially (or fully) prevent deformations of the hull of the vessel (or from the turret, whatever the case may be) from being transferred to the bearing assembly (specifically, said deformations substantially will be absorbed by the connecting element). The flexibility of the connecting element also allows for easy compensation of any misalignment of the turret relative to the turret casing. Thus the connecting element not only will experience tensile forces, but in some cases bending forces or other forces too (which, by the way, could result from many different causes).

In a first embodiment of the vessel, the arrangement of the mooring system is such that turret downwardly loads the turret casing. This may be the most common situation. Then the first end of the connecting element is positioned at a higher level then the second end thereof.

Because the first end of the connecting element (which is connected to the vessel) is positioned at a higher level then the second end of the connecting element (which carries the turret with all its components), loads on the connecting element are tensile forces which can be accommodated without the need for a strong (stiff) construction of the connecting element. Therefore the connecting element can be sufficiently flexible to prevent deformations of the hull of the vessel (or of the turret) from being transferred to the bearing assembly (specifically, said deformations will be absorbed by the connecting element).

In another embodiment of the vessel, the connecting element defines a substantially cone shaped body with a wider first end at its top and a narrower second end at its bottom.

The cone shape of such a body adds to a stable positioning of the narrower second end of the connecting element (and thus the turret) as a result of the radial components of the load generated by the cone shape.

It is noted that the expression "cone shaped body" merely tries to express the general outline of the connecting element. The cone shaped body can have a portion with a smaller cross-section than that of the other end with one or more wall segments joining the ends. It is not intended to limit the scope to a connecting element in which the cone shaped body comprises a continuous wall. Thus, also a cone shaped body defined by a number of separate members (for example tension rods extending longitudinally along the cone shaped 'body') will fall within the meaning of such an expression.

In another embodiment of the vessel, the mooring system is such that the turret upwardly loads the turret casing (for example when the turret is a buoyant body with large buoyancy). In such a case the first end of the connecting element is positioned at a lower level then the second end thereof. In such a case, also the connecting element may define a substantially cone shaped body, however now with a wider first end at its bottom and a narrower second end at its top.

In one embodiment, the cone shaped body of the connecting element is defined by a continuous thin-walled sheet material. In such an embodiment, the cone shaped body indeed has a continuous wall which allows the use of a rather flexible material (which, in a manner of speaking, will act as a membrane) while still preserving sufficient capability for carrying the (vertical) loads (i.e. loads between the ends of the body). It is noted, that 'thin-walled' should be considered within the context of vessels and, for example, may define a material which is a few centimetres thick.

For example, the sheet material may comprise a steel plate. However, depending on the specific application, also other materials might be used.

The position of the bearing arrangement may vary. For example the bearing arrangement may be located at the second end of the connecting element (near to or at the turret). This embodiment specifically is suited for preventing deformations from the hull of the vessel from being transferred to the bearing arrangement.

However, it is also possible that the bearing arrangement is located at the first end of the connecting element (near to or at the turret casing). In this case it is possible to prevent such a transferral of deformations from the turret towards the bearing arrangement (in such a case the turret casing might be provided with a torsion-box, as mentioned above).

For combining these effects it is possible that the bearing arrangement is located intermediate the first and second end of the connecting element.

Another aspect of the invention secondly relates to a mooring system presenting one or more of the features of the mooring system disclosed herein and being thus constructed and suitable for use in a vessel.

BRIEF DESCRIPTION OF THE DRAWINGS

Hereinafter the invention will be elucidated while referring to the drawing in which the figures show very schematically possible embodiments of the vessel with mooring system having aspects of the present invention.

DETAILED DESCRIPTION OF ILLUSTRATIVE EMBODIMENTS

Figure 1:
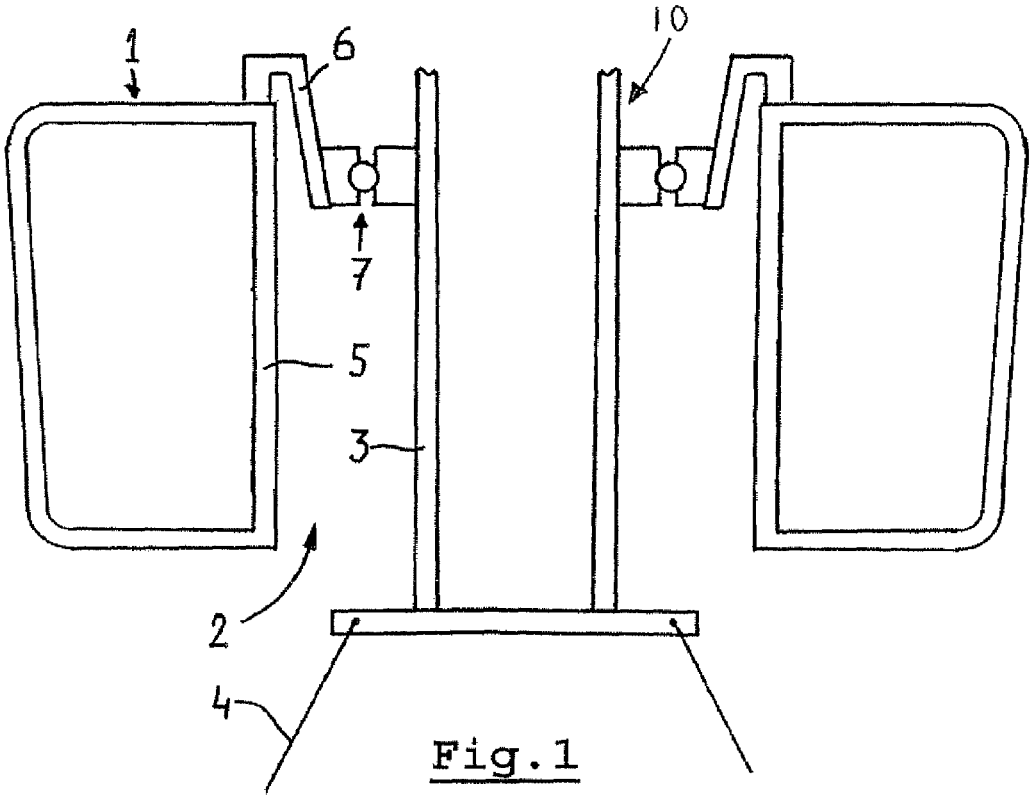
FIG. 1 shows a transverse section through a first embodiment of a vessel at the position of a mooring system.

Firstly referring to FIG. 1, an embodiment of a vessel (represented at 1) which is provided with a mooring system 10. The vessel 1 comprises a passage 2 through the vessel, a so-called moonpool, for receiving a turret 3. This turret 3 is anchored at the seabed (not illustrated) in a known manner, for example by mooring lines 4. However, it should be noted that lines 4 also or additionally could be production lines (for example for gas or oil) which also serve to anchor the turret 3.

In FIG. 1 this turret 3 has been illustrated schematically as a tube. It should be understood, however, that such a turret, as is known per se and therefore needs no further explanation, will have a far more complicated structure with a number of components which are not shown here.

The vessel 1 further is provided with a turret casing 5 connected to the vessel 1 and defining the circumference of the passage 2. In a way known per se and not illlustrated in detail here, such a turret casing 5 may comprise specific constructional elements for locally reinforcing the vessel 1. As can be seen clearly in FIG. 1, the turret 3 and turret casing 5 are rotatably interconnected by a connecting element 6 and a bearing arrangement 7. As a result, when the vessel 1 is connected to the turret 3 through the connecting element 6 and bearing arrangement 7, the vessel is free to weathervane (rotate) around the turret 3 (which, basically, has a geostatic position) such as to assume a position in which the loads acting on the vessel 1 (and, thus, on the turret 3 and mooring lines 4) are minimised.

The connecting element 6 has a flexibility such, that deformations of the hull of the vessel 1 will not or hardly be transferred to the bearing arrangement 7, which otherwise would deform and would get locked and would prevent the vessel from weathervaning (or, if such weathervaning still would be possible, would increase the wear on the bearing assembly). Or, in other words, the connecting element 6 serves to isolate the bearing assembly 7 from vessel ovaling. It therefore is essential that the connecting element 6 has sufficient flexibility.

It is noted that the mooring system 10 also could comprise couplings for enabling a quick disconnection between the vessel and the turret. Such couplings have not been shown here.

As shown in FIG. 1, in the illustrated embodiment the connecting element 6 defines a substantially cone shaped body with a wider first end (larger cross-section) at its top which is connected to the turret casing 5 and a narrower second end (smaller cross-section) at its bottom which is connected to the turret 3 (in the present embodiment through the bearing arrangement 7). Thus, the first end of the connecting element 6 which defines the connection with the vessel 1 is positioned at a higher level then the second end thereof defining the connection with the turret 3 (through the bearing arrangement 7). As a result, loads in the connecting element 6 mainly will be tensile forces and bending moments which can be accomodated easily without the need for designing the connecting element 6 as a heavy and stiff construction. Thus, the connecting element 6 can be flexible, as required for (substantially) isolating deformations of the vessel 1 from the bearing arrangement 7, without however the risk of collapsing due to the loads acting on the connecting element 6 (among which are the mooring and riser loads and the weight of the turret 3 with all its components, most of which have not been illustrated here but which will be evident to those having knowledge in the field).

In one embodiment, and as illustrated schematically in FIG. 1, the cone shaped body of the connecting element 6 is defined by a continuous thin-walled sheet material. As a result the connecting element 6 will generally act as a membrane which offers the required flexibility while being sufficiently strong to accomodate the tensile forces. For example, the sheet material can be a steel plate.

Figure 2:
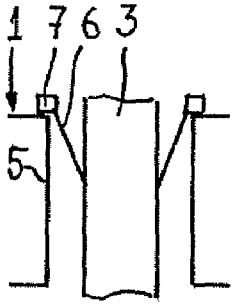
FIG. 2-4 show, schematically, embodiments of the vessel with different positions of the bearing arrangement.
Figure 3:
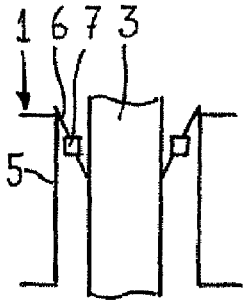
Figure 4:
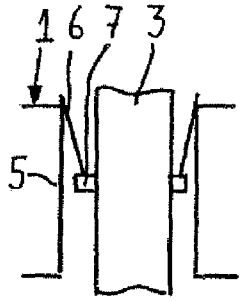

Shortly referring to FIGS. 2-4, three embodiments of the vessel are illustrated schematically, showing different positions of the bearing arrangement 7. The situation according to FIG. 4 corresponds with FIG. 1, and mainly is intended to substantially isolate deformations of the vessel 1 from the bearing arrangement 7. FIG. 2 shows a situation in which the bearing arrangement 7 is positioned near to or at the turret casing 5, and this embodiment could be used to isolate deformations of the turret 3 from the bearing arrangement 7 (which further, in this situation, possibly could be surrounded by a torsion-box structure as mentioned before such as to prevent deformations of the hull of the vessel 1 from influencing the bearing arrangement). Finally FIG. 3 relates to a situation in which the bearing arrangement 7 is positioned intermediate the turret casing 5 and turret 3 within the connecting element 6, such that deformations of the vessel 1 nor deformations of the turret 3 can negatively influence the operation of the bearing arrangement 7.

Figure 5:
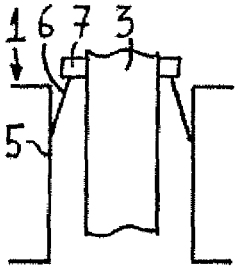
FIG. 5 shows an alternative embodiment with alternative position of the connecting element.

In FIG. 5 schematically an embodiment is illustrated in which the turret 3 loads the turret casing 5 upwardly (for example when the turret comprises a buoyant body with large buoyancy). Again, the connecting element 6 then will be loaded by tensile forces mainly. It is noted, that this embodiment is substantially equivalent to the embodiment according to FIG. 4, provided that one considers the turret 3 now as the vessel, and the vessel 1 as the turret (however, one can see then that it is not strictly necessary that the turret casing surrounds the turret; the turret also may surround the turret casing).

The alternative positions of the bearing arrangement according to the FIGS. 2-4 also could apply to the embodiment according to FIG. 5.

Figure 6:
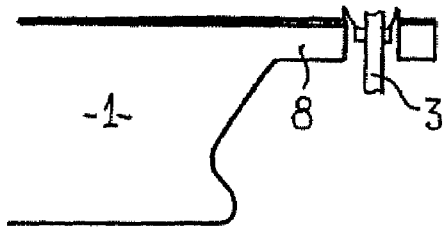
FIG. 6 shows an embodiment with alternative position of the mooring system.

Finally FIG. 6 illustrates an alternative position of the mooring system in an outrigger 8 connected to and extending beyond the hull of the vessel 1.

Aspects of the invention are not limited to the embodiments described above which may be varied widely within the scope of the invention as defined by the appending claims. For example, it is not strictly necessary that the connecting element 6 is cone shaped. It is conceivable too, for example, that its shape is substantially cylindrical which also operates in tension. Further the advantageous effects of the invention also could be obtained by a cone shaped connecting element of which the upper end (when connected to the vessel) is narrower then the lower end, although generally this would complicate the design. Moreover it should be noted that it is not strictly necessary for the connecting element to comprise a continous wall (such as the sheet material mentioned above). Also a connecting element defined by separate members (for example tension rods) defining an imaginary wall of the connecting wall and extending therealong from the lower end of the connecting element towards the upper end thereof, could provide the advantageous effects sought for by the present invention. Finally, the connection between the upper end of the connecting element and vessel may be provided with means which can be used to correctly align the turret within the moonpool of the vessel (for example hydraulic cylinder-piston assemblies), especially during assembly of the connecting element 6 in the vessel 1.

The invention claimed is:

1. A vessel with a mooring system, the mooring system comprising a turret anchorable to a seabed and a turret casing being part of the vessel, wherein the turret and turret casing are interconnected by a connecting element comprising a bearing arrangement and wherein the connecting element has a first end connected to the turret casing and an opposite second end connected to the turret, wherein the connecting element is positioned in such a manner that it experiences tensile force, wherein the turret downwardly loads the turret casing and wherein the first end of the connecting element is positioned at a higher level than the second end thereof, and wherein the connecting element defines a substantially cone shaped body having a wider first end with a larger cross-section at its top and a narrower second end having a smaller cross-section at its bottom.

2. The vessel according to claim 1, wherein the body of the connecting element is defined by a continuous thin-walled sheet material.

3. The vessel according to claim 2, wherein the sheet material is a steel plate.

4. The vessel according to claim 1, wherein the bearing arrangement is located at the second end of the connecting element.

5. The vessel according to claim 1, wherein the bearing arrangement is located at the first end of the connecting element.

6. A vessel with a mooring system, the mooring system comprising a turret anchorable to a seabed and a turret casing being part of the vessel, wherein the turret and turret casing are interconnected by a connecting element comprising a bearing arrangement and wherein the connecting element has a first end connected to the turret casing and an opposite second end connected to the turret, wherein the connecting element is positioned in such a manner that it experiences tensile force, and wherein the bearing arrangement is located intermediate the first and second end of the connecting element.

7. The vessel according to claim 6, wherein the turret downwardly loads the turret casing and wherein the first end of the connecting element is positioned at a higher level than the second end thereof.

8. The vessel according to claim 7, wherein the connecting element defines a substantially cone shaped body having a wider first end with a larger cross-section at its top and a narrower second end having a smaller cross-section at its bottom.

9. The vessel according to claim 6, wherein the turret upwardly loads the turret casing and wherein the first end of the connecting element is positioned at a lower level then the second end thereof.

10. The vessel according to claim 9, wherein the connecting element defines a substantially cone shaped body having a wider first end with a larger-cross section at its bottom and a narrower second end having a smaller cross-section at its top.

11. A mooring system comprising a turret anchorable to a seabed and a turret casing being part of the vessel, wherein the turret and turret casing are interconnected by a connecting element comprising a bearing arrangement and wherein the connecting element has a first end connected to the turret casing and an opposite second end connected to the turret, wherein the connecting element is positioned in such a manner that it experiences tensile force, wherein the turret downwardly loads the turret casing and wherein the first end of the connecting element is positioned at a higher level than the second end thereof, and wherein the connecting element defines a substantially cone shaped body having a wider first end with a larger cross-section at its top and a narrower second end having a narrow cross-section at its bottom.

12. The mooring system according to claim 11, wherein the body of the connecting element is defined by a continuous thin-walled sheet material.

13. The mooring system according to claim 12, wherein the sheet material is a steel plate.

14. The mooring system according to claim 11, wherein the bearing arrangement is located at the second end of the connecting element.

15. The mooring system according to claim 11 wherein the bearing arrangement is located intermediate the first and second end of the connecting element.

16. A mooring system comprising a turret anchorable to a seabed and a turret casing being part of the vessel, wherein the turret and turret casing are interconnected by a connecting element comprising a bearing arrangement and wherein the connecting element has a first end connected to the turret casing and an opposite second end connected to the turret, wherein the connecting element is positioned in such a manner that it experiences tensile force, and wherein the bearing arrangement is located at the first end of the connecting element.

17. The mooring system according to claim 16, wherein the turret downwardly loads the turret casing and wherein the first end of the connecting element is positioned at a higher level than the second end thereof.

18. The mooring system according to claim 17, wherein the connecting element defines a substantially cone shaped body having a wider first end with a larger cross-section at its top and a narrower second end having a narrow cross-section at its bottom.

19. The mooring system according to claim 16, wherein the turret upwardly loads the turret casing and wherein the first end of the connecting element is positioned at a lower level than the second end thereof.

20. The mooring system according to claim 19, wherein the connecting element defines a substantially cone shaped body having a wider first end with a larger-cross section at its bottom and a narrower second end having a narrow cross-section at its top.

* * * * *